US005333556A

United States Patent [19]

Isobe et al.

[11] Patent Number: 5,333,556

[45] Date of Patent: Aug. 2, 1994

[54] DOUBLE PRESS SCREW

[75] Inventors: Seiichiro Isobe; Akinori Noguchi; Kunihiko Uemura, all of Ibaragi, Japan

[73] Assignee: Director of National Food Research Institute, Ministry of Agriculture, Forestry and Fisheries, Japan

[21] Appl. No.: 860,120

[22] Filed: Mar. 31, 1992

Related U.S. Application Data

[63] Continuation of Ser. No. 497,622, Mar. 23, 1990, abandoned.

[30] Foreign Application Priority Data

Mar. 24, 1989 [JP] Japan ..... 1-72379

[51] Int. Cl.[5] ..... B30B 15/34; B30B 9/16

[52] U.S. Cl. ..... 100/93 S; 100/117; 100/128; 100/146; 366/147; 366/301

[58] Field of Search ..... 100/93 S, 117, 126–129, 100/145–150; 366/186, 83–85, 97, 147, 300, 301

[56] References Cited

U.S. PATENT DOCUMENTS

| | | | |
|---|---|---|---|
| 829,315 | 8/1906 | Anderson | 100/129 X |
| 1,366,307 | 1/1921 | ten Bosch | 100/128 X |
| 1,539,340 | 5/1925 | Sizer | 100/128 X |
| 1,700,407 | 1/1929 | Hiller | 100/128 X |
| 1,739,459 | 12/1929 | Hiller | 100/128 X |
| 1,828,968 | 10/1931 | Hiller et al. | 100/128 X |
| 2,119,162 | 5/1938 | Hartner | 100/146 |
| 2,320,765 | 6/1943 | Upton | 100/93 S |
| 2,360,984 | 10/1944 | Schmitz, Jr. | 100/146 |
| 2,550,226 | 4/1951 | Colombo | 100/146 X |
| 2,567,219 | 9/1951 | Lesniak | 100/146 |
| 2,687,084 | 8/1954 | Bowman | 100/93 S |
| 2,687,830 | 8/1954 | Doering | 100/93 S X |
| 3,215,355 | 11/1965 | Shouvlin et al. | 100/146 X |
| 3,460,466 | 8/1969 | Ginaven et al. | 100/146 X |
| 3,461,793 | 9/1969 | Solberg | 100/146 X |
| 3,548,742 | 12/1970 | Seufert et al. | 100/146 X |
| 3,900,187 | 8/1975 | Loomans | 366/85 |
| 3,907,259 | 9/1975 | Leclercq | 366/85 |

FOREIGN PATENT DOCUMENTS

| | | | |
|---|---|---|---|
| 18950/29 | of 1929 | Australia | 100/128 |
| 18365 | 7/1928 | Netherlands | 100/146 |
| 80359 | 6/1952 | Norway | 100/146 |
| 609948 | 3/1979 | Switzerland | 366/85 |
| 1530133 | 3/1963 | U.S.S.R. | 100/146 |
| 559721 | 8/1977 | U.S.S.R. | 366/83 |

*Primary Examiner*—Stephen F. Gerrity
*Attorney, Agent, or Firm*—Howard L. Rose

[57] ABSTRACT

A double-screw press for separating a liquid from a two-phase solid-liquid material includes a hollow barrel and two screws disposed in the barrel. The barrel comprises a plurality of detachable barrel plates and a plurality of spacers disposed between the barrel plates and cooperating with the barrel plates in defining slits. The screws are arranged side by side with a gap defined therebetween, and are rotated by a motor to move a material, which has been charged into the barrel, efficiently from an upstream end to a downstream end of the barrel. The barrel plates and the screws have respective passages connected to cooling water sources, which supply cooling water to keep the temperature in the screws and the barrel at a desired level. The charged material is crushed and mixed in the gap between the screws, and oil is expressed from the material when it is compressed in the barrel. The expressed oil is discharged through the slits and collected in a container.

4 Claims, 3 Drawing Sheets

DOUBLE PRESS SCREW

This is a continuation of co-pending application Ser. No. 07/497,622, filed on Mar. 23, 1990 now abandoned.

BACKGROUND OF THE INVENTION

1. Field of the Invention:

The present invention relates to a press for separating liquid from a two-phase solid-liquid material, and more particularly to a double-screw expeller for expressing vegetable oil from seeds.

2. Description of the Relevant Art:

Apparatus for expressing oil, water, and other liquids from various materials such as vegetable seeds, e.g., sesame seeds and sunflower seeds, animal meat by-products, starch, etc,, are generally classified into batch presses and continuous presses. The batch presses include cage presses and filter presses. These batch presses are mainly used to manufacture a Japanese alcoholic beverage known as "sake" and soy sauce since they can separate clear high-quality liquids from the material using cloth filter bags. Typical continuous presses are roller mills. In a roller mill, since the material from which a liquid is to be separated is pressed under a relatively low pressure, a large amount of liquid remains in the cake after expression by the roller mill. Therefore, use of the roller mills is primarily limited to dewatering of starch.

Another form of continuous press is a screw press which is particularly suitable for expressing vegetable oil from oilseeds. One typical screw press comprises a barrel and a screw closely fitted in the barrel. The barrel may comprise a cylindrical barrel having a multiplicity of holes or a drainage barrel having slits extending along the screw with spacers therebetween. In the screw press, the seeds from which oil is to be expressed are fed forward by friction with the inner circumferential surface of the barrel. In order for the seeds to be moved by friction, their protective shells, known as testa, must be left uncrushed. The materials that can be processed by the screw press are therefore limited to oil seeds and materials with high fibrous content. Oil which is expressed by the screw press should be refined because it contains testa. However, the refining process is costly and laborious. Other problems of the screw press are that the barrel are rapidly worn by frictional contact with the material and the material tends to be modified in property due to frictional heat.

SUMMARY OF THE INVENTION

It is an object of the present invention to provide a double-screw press which can efficiently express a high-quality liquid from a material.

Another object of the present invention is to provide a double-screw press which is highly durable and economical.

A double-screw press according to the present invention has a hollow barrel having a feed inlet at an upstream end thereof, for feeding a material into the hollow barrel, a cake outlet at a downstream end thereof, for discharging a cake produced after the material is pressed, and a plurality of slits between the upstream and downstream ends, for passing therethrough a liquid which is expressed from the material. A pair of screws is disposed side by side in the barrel and operable in coaction with each other for moving the material therealong while crushing and mixing the same. The screws are spaced from each other by a gap depending on the particle size of the material. The gap is defined between the surfaces of the crushing means of the screws, the gap being constant between all surfaces along the operative length of the screws and large enough only to pass the material therethrough. The screws may not be held in full mesh with other, with the gap therebetween being large enough to pass the material therethrough. The material charged into the barrel is crushed and mixed in the gap between the screws, and oil is expressed from the material when it is compressed in the barrel. The expressed oil is discharged through the slits. The screws may be held in full mesh with each other depending on the material to be pressed.

The barrel has a plurality of barrel plates having respective openings through which the screws extend, and a plurality of spacers disposed between the barrel plates and cooperating with the barrel plates in defining the slits. Since the particle size of the material becomes progressively smaller as it is compressed, it is preferable for the slits to have a larger width near the upstream end of the barrel and a smaller width near the downstream end thereof. Therefore, the thickness of the spacers is progressively smaller from the upstream end to the downstream end. To prevent the material from flowing backward along the screws, the edges of the barrel plates which define the openings in the barrel plates and the outer peripheral surfaces of the screws are disposed closely to each other.

The double-screw press further includes a means for supplying a cooling medium such as cooling water to prevent some charged materials from being modified in property by heat. The cooling medium supplying means comprises passages defined in the screws and connected to a cooling water source. The cooling water source supplies cooling water into the passages in the screws to keep the temperature in the screws and barrel at a desired level. Each of the barrel plates also has a passage defined therein around the opening therein. The passages in the barrel plates are connected to another cooling water source, which supplies cooling water into the barrel plates to keep the temperature in the barrel at a desired level. When it is necessary to increase the temperature in the screws and the barrel, a heated medium such as heated water, steam, or the like may be supplied to the passages in the screws and the barrel plates.

The principles of the present invention will be described with particular reference to expression of vegetable oil from seeds. However, the present invention is also applicable generally to separation of a liquid from a solid, such as dewatering of industrial wastes having high water contents.

The above and further objects, details and advantages of the present invention will become apparent from the following detailed description of a preferred embodiment thereof, when read in conjunction with the accompanying drawings.

DETAILED DESCRIPTION OF THE PREFERRED EMBODIMENT

Figure 1:
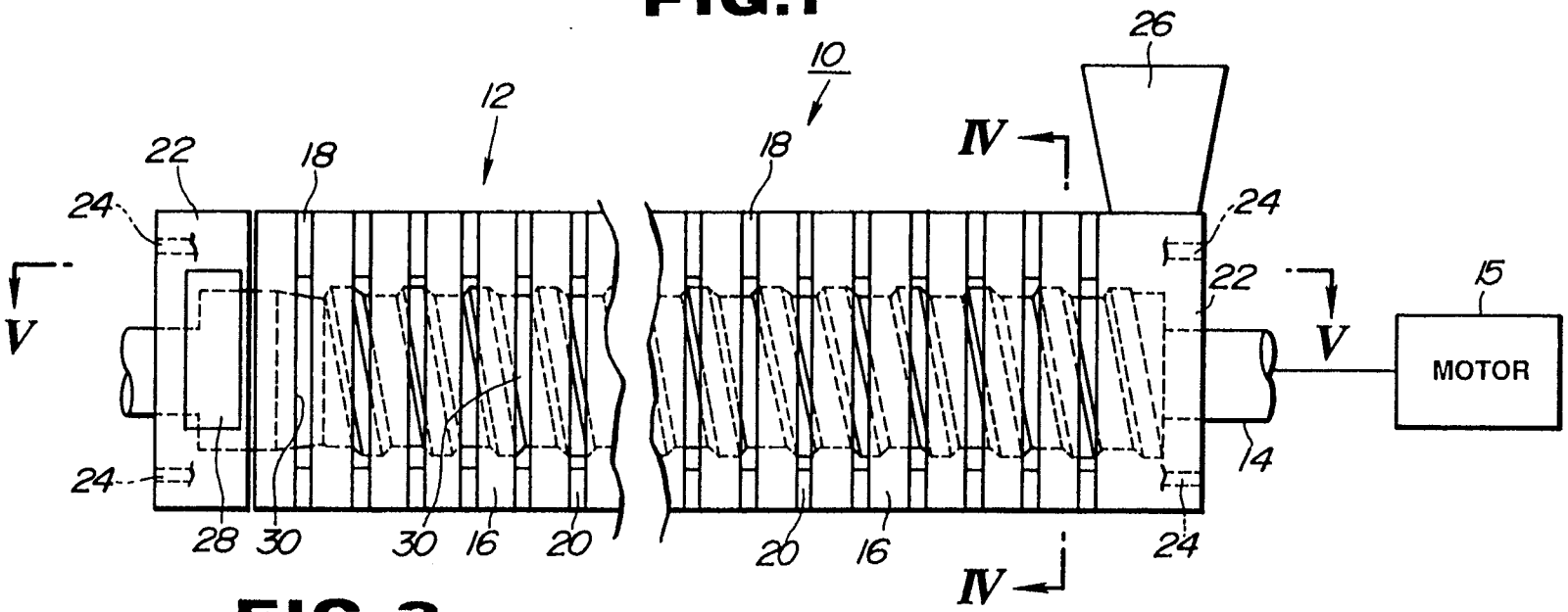
FIG. 1 is a front elevational view of a double-screw press according to the present invention.
Figure 3:
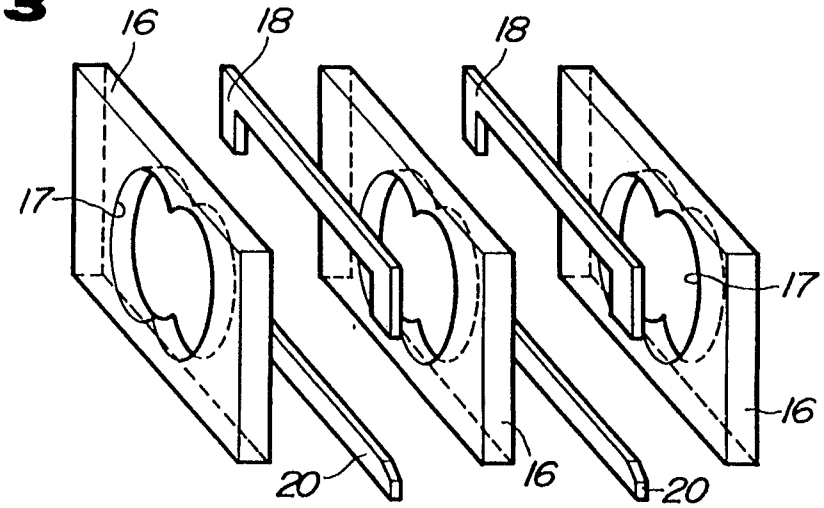
FIG. 3 is an exploded perspective view of a portion of a barrel of the double-screw press.
Figure 2:
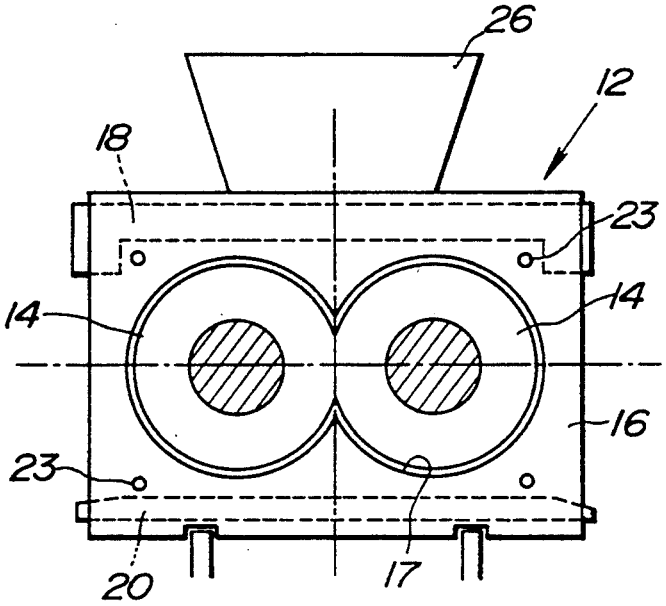
FIG. 2 is a side elevational view of the double-screw press shown in FIG. 1.

As shown in FIGS. 1 and 2, a double-screw press 10 according to the present invention comprises a horizontal barrel 12 and a pair of screws 14 extending horizontally in the barrel 12 and rotatable about their own axes by a suitable actuator 15 such as a motor. As shown in FIG. 3, the barrel 12 comprises a plurality of barrel plates 16 which have openings 17 through which the screws 14 extend, inverted U-shaped upper spacers 18 disposed between upper portions of adjacent ones of the barrel plates 16, slender rod-shaped lower spacers 20 disposed between lower portions of the adjacent ones of the barrel plates 16, and end plates 22 at the opposite ends of the barrel 12. The barrel plates 16 and the two end plates 22 have through insertion holes 23, 24, respectively see FIG. 2. Tie bars (not shown) are inserted through the insertion holes 23, 24, and nuts (not shown) are tightened on opposite ends of the tie bars. Therefore, barrel plates 16, upper and lower spacers 18, 20, and the end plates 22 are firmly fastened together, completing the barrel 12.

The barrel 12 has a feed inlet 26 for feeding a material into the barrel 12, in the form of a hopper which is vertically mounted on an upper surface of the upstream end of the barrel 12. The barrel 12 also has a cake outlet 28 in one side of the downstream end thereof, for discharging a cake from the barrel 12 after expression of oil from the material. Vertical slits 30 are defined between the barrel plates 16. The slits 30 are progressively narrower from the upstream end to the downstream end so that the widths of the slits 30 match the particle sizes of a material which is continuously pressed and moved forward in the barrel 12. Therefore, the spacers 18, 20 are thickest at the upstream end of the barrel 12, and thinnest at the downstream of the barrel 12.

Figure 4:
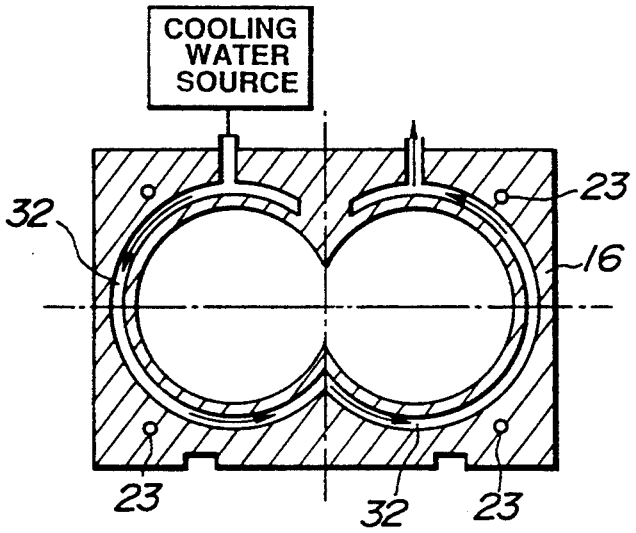
FIG. 4 is a cross-sectional view taken along line IV—IV of FIG. 1.

As shown in FIG. 4, each of the barrel plates 16 has a passage 32 defined therein and extending closely around the opening 17. The passage 32 is connected to a cooling water source 33 which supplies cooling water into the barrel 12 to keep the temperature therein at a desired level. If necessary, a heated medium source for supplying a heated medium such as steam, heated water, heated oil, or the like may be connected to the passages 32, depending on the material to be pressed.

Figure 5:
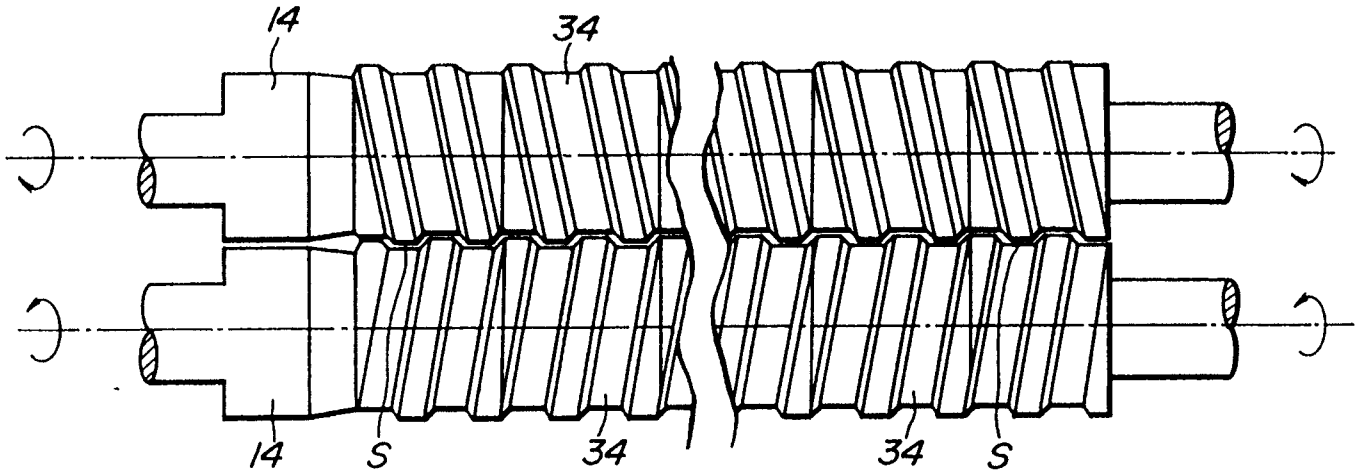
FIG. 5 is a cross-sectional view taken along line V—V of FIG. 1.

The screws 14 extend horizontally parallel to each other in the opening 17 in the barrel plate 16. In order to prevent the material, which is being pressed, from moving backward along the screws 14, the gap between the screws 14 and the edges of the barrel plates 16 which define the openings 17 should be as small as possible. If the screws 14 operate in full mesh with each other, they can feed the material at a maximum rate, but mix and grind the material at a minimum rate. If the screws 14 operate in partial mesh with each other, i.e., with a gap S (FIG. 5) left therebetween, they feed the material at a lower rate, but can mix and grind the material at an increased rate. The gap S is adjusted depending on the nature and particle size of the material to be processed. For example, the gap S is smaller when relatively small seeds such as sesame seeds or rapeseeds are pressed, and larger when larger-particle materials such as palm kernels are pressed. If a material which has already been crushed is supplied, then the screws 14 are held in full mesh with each other during operation.

Figure 6:
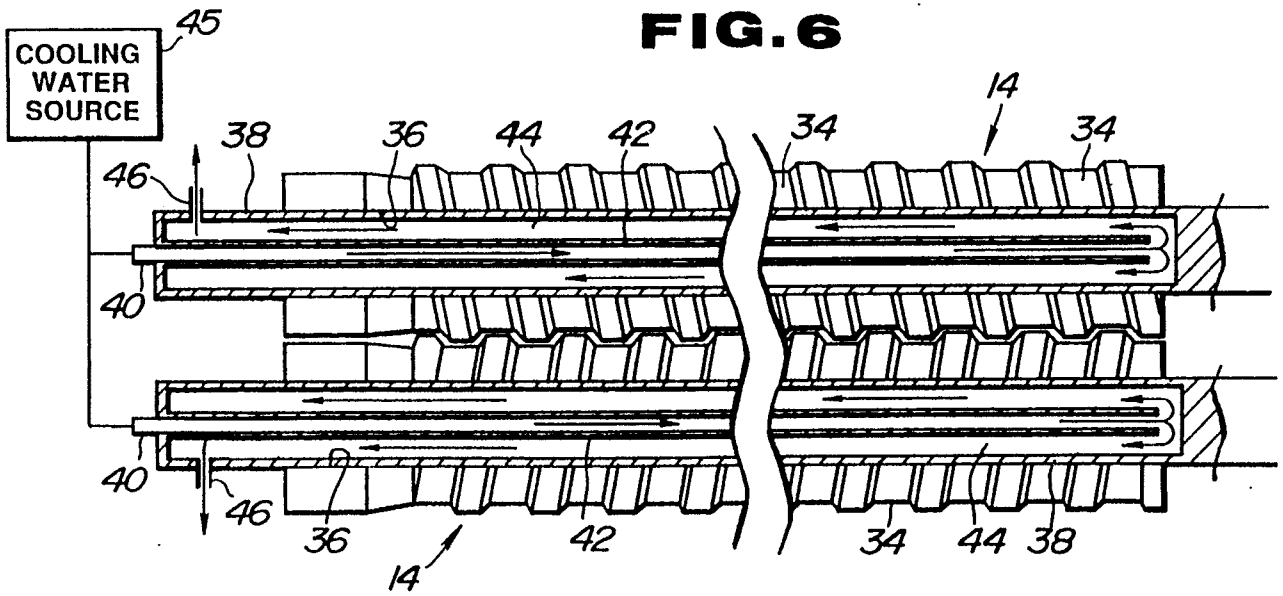
FIG. 6 is a cross-sectional view, partly in elevation, of a pair of screws in the double-screw press.

Each of the screws 14 comprise a plurality of segments 34 which are axially detachably coupled together so that they may easily be replaced or other segments may easily be added. If several segments 34 are added and corresponding barrel plates 16 and spacers 18, 20 are also added, the barrel 12 can be axially elongated. As shown in FIG. 6, each of the screws 14 has a hollow space 36 in which a pipe 38 axially extends. The pipe 38 has an inlet 40 at one end thereof which is exposed out of the screw 14. The inlet 40 is connected to a cooling water source 45. A smaller-diameter inner pipe 42 horizontally extends from the inlet 40 to a position near the opposite end of the pipe 38. The inner peripheral surface of the pipe 38 and the outer peripheral surface of the inner pipe 42 jointly define a passage 44 therebetween which communicates with an outlet 46 near the inlet 40. When cooling water is supplied from the cooling water source 45 to the inlet 40 of each screw 14, the cooling water flows through the inner pipe 42 and then the passage 44 and out of the outlet 46. The cooling water which flows in the screws 14 serves to keep the temperature in the screws 14 and the barrel 12 at a desired level.

Operation of the double-screw press 10 thus constructed will be described below.

A suitable quantity of sunflower seeds, for example, is charged into the barrel 12 through the feed inlet 26. The screws 14 which are spaced the gap S from each other are rotated in opposite directions as indicated by the arrows in FIG. 5. The charged sunflower seeds are crushed and mixed in the gap S between the screws 14. Since the sunflower seeds which tend to rotate with one of the screws 14 are prevented from so rotating by the other screw 14 (i.e., by its helical rib), the sunflower seeds effectively move forward from the upstream end to the downstream end of the barrel 12 while sliding on the surfaces of the screws 14. The screws 14 may be rotated in the same direction depending on the material to be pressed. Oil is expressed from the sunflower seeds which are crushed and mixed when the seeds are compressed by the progressively smaller volume of the internal space of the barrel 12 and also by subsequently charged sunflower seeds. The expressed oil flows out of the barrel 12 through the slits 30 and is collected in a container (not shown). The cake is discharged from the cake outlet 28. The cake may be used as a high-protein material though it contains unwanted components such as chlorogenic acid, for example.

A sunflower seed contains 50% by weight of oil. When oil was expressed from threshed sunflower seeds using a single-screw press, the expressing efficiency (i.e., the ratio of expressed oil to the oil content of the sunflower seeds) was only 20%. The low expressing efficiency was caused since the sunflower seeds stayed in the barrel and turned into a paste, with the result that separation of the liquid phase from the solid phase was not sufficient. When oil was expressed from sunflower seeds which had not been threshed, the expressing efficiency was 75%. when oil was expressed from sunflower seeds using the double-screw press of the present invention, the expressing efficiency was 90% or higher, and 93% at maximum. The electric power consumed per kilogram of expressed oil was 0.2 kilowatt for the double-screw press and 1.25 kilowatts for the single-screw press. This power consumption difference was due to different frictional effects which the double- and single-screw presses had on the sunflower seeds.

Although there has been described what is at present considered to be the preferred embodiment of the present invention, it will be understood that the invention may be embodied in other specific forms without departing from the essential characteristics thereof. The present embodiment is therefore to be considered in all aspects as illustrative, and not restrictive. The scope of the invention is indicated by the appended claims rather than by the foregoing description.

We claim:

1. A double screw press for separating a liquid from a two-phase, solid-liquid material, comprising:

a hollow barrel having a feed inlet at an upstream end thereof, for feeding a material into the hollow barrel, a cake outlet at a downstream end thereof, for discharging a cake produced after the material is pressed, and a plurality of slits between said upstream and downstream ends, for passing therethrough a liquid which is expressed from the material;

a pair of screws disposed side by side in said barrel and operable in coaction with each other for moving the material therealong while crushing and mixing the same; and actuator means for rotating said screws, said barrel comprising a plurality of barrel plates having respective openings through which said screws extend;

a plurality of spacer means disposed between said barrel plates and cooperating with said barrel plates in defining said slits;

said spacer means having a thickness which is progressively smaller from said upstream end to said downstream end of said barrel.

2. A double-screw press for separating a liquid from a two-phase solid-liquid material, comprising:

a hollow barrel having a feed inlet at an upstream end thereof, for feeding a material into the hollow barrel, a cake outlet at a downstream end thereof, for discharging a cake produced after the material is pressed, and a plurality of slits between said upstream and downstream ends, for passing therethrough a liquid which is expressed from the material;

a pair of screws disposed side by side in said barrel and operable in coaction with each other for moving the material therealong while mixing the same;

wherein all surfaces of said pair of screws include crushing means for crushing the material while it is moving and being mixed, said crushing means defining a gap between said screws, said gap being constant between all surfaces along the entire length of the screws and large enough only to pass the material therethrough;

actuator means for rotating said screws;

said barrel comprising a plurality of transverse barrel plates having respective openings through which said screws extend; and a plurality of spacer means disposed between said barrel plates and cooperating with said barrel plates in defining said slots.

3. A double-screw press according to claim 2, further comprising a source of a temperature-regulating medium, each of said barrel plates having a passage defined therein and connected to said source.

4. A double-screw press according to claim 3, wherein said passage in each of said barrel plates extends closely around said opening in the barrel plate.

* * * * *

UNITED STATES PATENT AND TRADEMARK OFFICE

CERTIFICATE OF CORRECTION

PATENT NO. : 5,333,556

DATED : August 2, 1994

INVENTOR(S) : Seiichiro Isobe et al

It is certified that error appears in the above-identified patent and that said Letters Patent is hereby corrected as shown below:

Claim 2, column 6, line 30, change "slots" to --slits--.

Signed and Sealed this

Sixteenth Day of January, 1996

Bruce Lehman

*Attest:*

BRUCE LEHMAN

*Attesting Officer*

*Commissioner of Patents and Trademarks*